US005375293A

United States Patent [19]

Gilbertson

[11] Patent Number: 5,375,293

[45] Date of Patent: Dec. 27, 1994

[54] VACUUM OPERATED IN-LINE RETRIEVAL DEVICE

[76] Inventor: Mark D. Gilbertson, 3940 Zarthan Ave. S., St. Louis Park, Minn. 55416

[21] Appl. No.: 96,882

[22] Filed: Jul. 26, 1993

[51] Int. Cl.[5] ..... A47L 9/12

[52] U.S. Cl. ..... 15/339; 15/352; 55/309; 55/482; 55/486

[58] Field of Search ..... 15/339, 347, 353; 55/309, 422, 482, 486

[56] References Cited

U.S. PATENT DOCUMENTS

| | | | |
|---|---|---|---|
| 2,293,920 | 8/1942 | Replogle | 15/339 X |
| 2,351,068 | 6/1944 | Replogle | 15/339 X |
| 2,354,089 | 7/1944 | Replogle | 15/339 X |
| 4,833,753 | 5/1989 | Müller | 15/352 X |

*Primary Examiner*—Chris K. Moore
*Attorney, Agent, or Firm*—Frederick W. Niebuhr

[57] ABSTRACT

A retrieval and collection device is adapted for removable coupling in-line to a conventional portable vacuum cleaning system, at an upstream end of a vacuum hose. The retrieval device includes a casing with a relatively large diameter medial region and respective upstream and downstream coupling sleeves at opposite ends of the casing. The casing consists of two casing sections joined along the casing medial region for periodic disassembly to remove captured articles. The size of articles to be captured is determined by a flat, disc-like screen removably mounted in a chamber defined by the casing medial region. Multiple apertures through the screen are substantially uniform in size to capture objects of at least a given dimension. Separate screens with apertures of different sizes can be interchangeably mounted in the chamber. Each screen is part of a partition device that further includes a collar surrounding the screen and a handle projected axially from the center of the screen. Each collar has an outside diameter slightly less than the inside diameter of the chamber and an axial dimension sufficient to stabilize the screen orientation while allowing axial movement of the screen relative to the casing. If desired, two or more partition devices can be arranged in tandem, whereby retrieved articles are sorted by size.

20 Claims, 3 Drawing Sheets

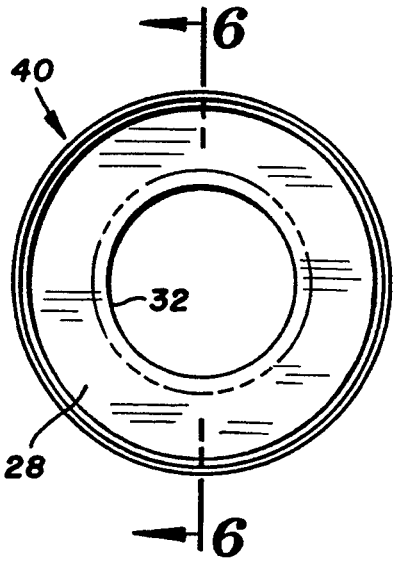
FIG.5
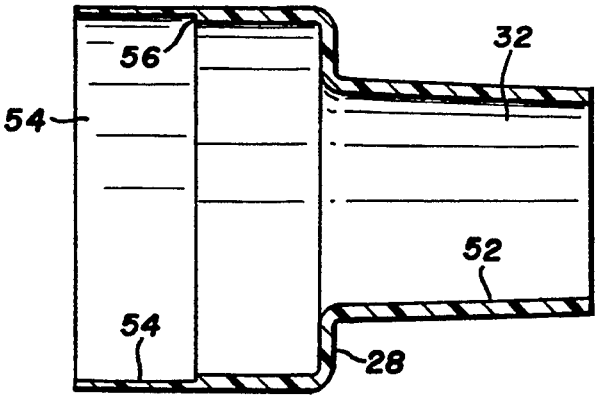
FIG.6
FIG.7
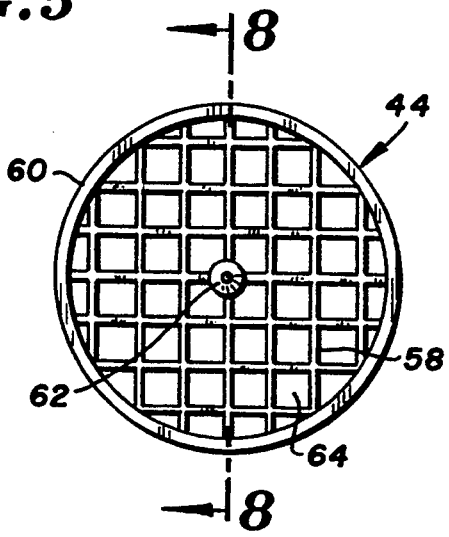
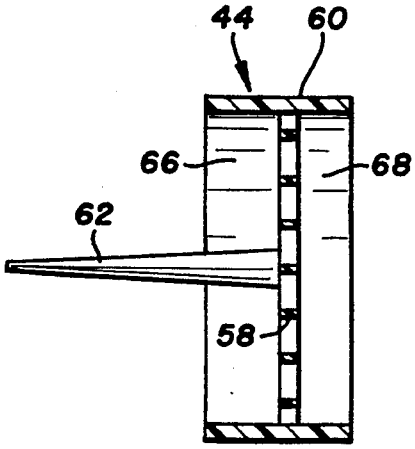
FIG.8
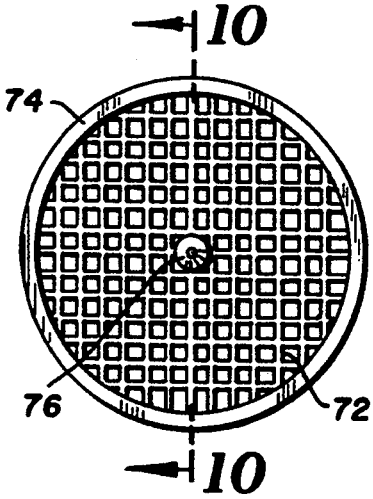
FIG.9
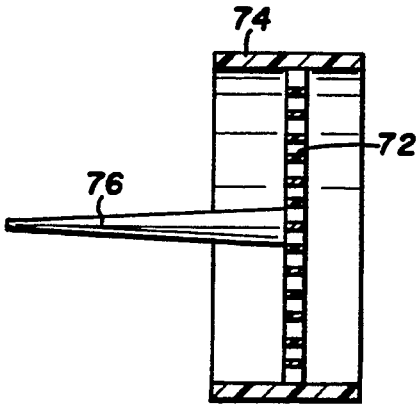
FIG.10

VACUUM OPERATED IN-LINE RETRIEVAL DEVICE

BACKGROUND OF THE INVENTION

The present invention relates to attachments for vacuum cleaning systems, and more particularly to a device removably coupled to a standard vacuum system for retrieving objects from a vacuum-drawn fluid stream, and for sorting retrieved objects by size if desired.

Vacuum cleaning devices and systems are well known and widely used, in homes and throughout industry. The most common household vacuum appliances are portable, and draw an airstream to lift dust, food particles and other small debris away from carpeting. Other appliances, known as "wet/dry" vacuum cleaners, are capable of drawing water or other liquids as an alternative to drawing air. In homes, this type of appliance is frequently used in workshop areas, basements or outdoors.

In business and industry, vacuum cleaning appliances and systems are employed for many of the same reasons as their household counterparts, e.g. cleaning carpeting, furniture and workshop areas. Further, they are employed extensively in manufacturing areas to maintain cleanliness and avoid undue and potentially hazardous accumulation of scrap or other manufacturing byproducts.

As they pick up debris, vacuum cleaning appliances often collect items not intended for disposal, e.g. coins, small toys and rings or other pieces of jewelry. If such unintended pickup goes unnoticed, such items are discarded and lost for good. Alternatively the operator may be alerted to the unintended pickup, e.g. by the sound of such item as it travels through the vacuum line. Then, the operator faces the unpleasant task of retrieving the item from a bag or canister filled with dust and other debris. Given the potential for such debris containing pins and other sharp objects, the retrieval task also presents the risk of injury to the operator.

In industry, these problems are magnified. For example, an electrical assembly operation usually requires thousands of small, yet valuable circuit components that are difficult to locate and retrieve if they are misplaced or fall to the floor. In wood and metal fabrication areas, nails, screws and the like can get lost among unwanted debris such as sawdust and metal lo shavings. Efforts to retrieve valuable items among such debris can lead to injury. Metal shavings and broken glass may damage the vacuum equipment, e.g. by cutting the hose.

Therefore, it is an object of the present invention to provide a device for safely retrieving small objects lost in sawdust, shavings or other debris.

Another object of the invention is to provide a means for removing dust and other foreign matter from objects as they are being retrieved.

A further object is to provide a device suited for removable or releasable coupling to a standard vacuum cleaning appliance to enable use of the vacuum cleaning appliance for retrieving and sorting small objects.

Yet another object is to provide an attachment for a portable vacuum cleaning appliance, removably secured near an upstream end of appliance hosing for protecting the hosing and other appliance components from damage due to broken glass, scraps of wood and metal, or other relatively large and/or sharp objects.

SUMMARY OF THE INVENTION

To achieve these and other objects, there is provided a retrieval device adapted for removable mounting in-line into a vacuum system via standard friction-fit couplings of vacuum system components. The retrieval device comprises a substantially rigid annular casing including a medial region defining a collection chamber. An upstream sleeve of the casing extends away from an upstream wall portion of the medial region. A downstream sleeve extends away from a downstream wall portion of the medial region. The upstream and downstream sleeves are in fluid communication with the collection chamber, to accommodate axial flow of a fluid into and out of the collection chamber. Each of the upstream and downstream sleeves has a nominal diameter substantially less than a nominal diameter of the collection chamber. A partition means is provided in the chamber, including a substantially disc-shaped first screen spanning the chamber to divide the chamber into upstream and downstream compartments, respectively upstream and downstream of the first screen. Multiple first apertures are formed through the first screen of a size selected to allow substantially uninterrupted flow of the fluid therethrough, while preventing passage of articles having at least a first predetermined size. The screen thus captures the articles in the upstream compartment. The casing includes two casing sections removably engaged with one another along the medial region. This facilitates removal of the articles from the collection chamber. The downstream sleeve is selectively shaped for a removable, frictional coupling with a standard tapered coupling of a component of a vacuum system.

Preferably the sleeves and collection chamber are concentric on a longitudinal central axis, with the diameters of the sleeves being substantially equal to one another and at most one-half of the collection chamber diameter. Consequently, the cross-sectional area of the collection chamber, taken transversely (i.e. perpendicular to the longitudinal axis), is at least four times the corresponding cross-sectional areas of the sleeves. Under steady state conditions of constant volumetric fluid flow, the average fluid velocity in the axial direction decreases along the collection chamber. The linear velocity reduction enhances the tendency for some of the suspended objects to fall out of the fluid stream due to gravity, improving performance of the device. The larger area screen is less likely to clog and the larger volume collection chamber requires evacuation less frequently.

It is advantageous to construct the casing of a transparent material, e.g. cellulose plastic or high density polyethylene. This provides a visual indication to the operator of the need to remove collected objects from the chamber. Moreover, when the operator observes pieces of broken glass or other potentially injurious fragments in the chamber, he or she is alerted of the need to exercise care when opening the casing to remove articles. A transparent casing further allows visual inspection for valuable objects that merit recovery before opening the casing.

According to one aspect of the invention, the partition means further includes an alignment means for maintaining the first screen in a selected orientation within the chamber, and for maintaining the screen axially spaced apart from the upstream and downstream wall portions while permitting the screen to move axially relative to the chamber for removal of the screen from the chamber. Such means can take the form of a collar surrounding and integral with the screen, and having collar portions that extend axially in both directions from the screen such that the axial length of the collar is at least one-third of the chamber diameter. The collar outside diameter approximates the chamber diameter, but is slightly less to permit axial sliding of the collar within the chamber. The axial length of the collar imparts stability in orienting the screen, despite the freedom of longitudinal movement. In one version of the invention, the screen is oriented transversely. In another embodiment, the screen is disposed at an oblique angle relative to the central axis. The oblique orientation takes up more room within the chamber, but provides increased screen surface area.

According to a further aspect of the invention, a second disc-shaped screen is mounted within the chamber, axially spaced apart upstream of the first screen. The second screen thus divides the upstream compartment into first and second subcompartments. Multiple apertures through the second screen have a size selected to prevent the passage of articles having at least a second predetermined size larger than the first predetermined size. Articles of at least the second predetermined size are captured in the second subcompartment, while articles of at least the first predetermined size, but less than the second predetermined size, are captured in the first subcompartment. Accordingly, collected articles are sorted as to their size. The second screen, like the first, preferably is mounted for sliding within the chamber by virtue of an annular collar surrounding the screen. The screens and collars, like the casing, are preferably transparent.

According to yet another aspect of the invention, the upstream sleeve is shaped for friction-fit joinder to standard tapered couplings of vacuum components. This allows in-line mounting of the device, much the same as other vacuum attachments are mounted. The preferred positioning of the device is at the upstream end of a vacuum hose, either forming the upstream end of the vacuum system or being immediately downstream of a wand or other intake attachment. The sleeve fittings facilitate convenient attachment and removal of the device by the familiar "push-pull" action. Thus, the device can be employed to retrofit existing conventional vacuum systems, particularly portable systems, without any modification to pre-existing equipment.

IN THE DRAWINGS

For a further understanding of the above and other features and advantages, reference is made to the following detailed description and to the drawings in which:

FIG. 5 is an end view of the other casing section;

FIG. 6 is a sectional view taken along the line 6—6 in FIG. 5;

FIG. 7 is an end view of a screen removably contained within the casing;

FIG. 8 is a sectional view taken along the line 8—8 in FIG. 7;

FIG. 9 is an end view of another screen suited for removable mounting inside the casing;

FIG. 10 is a sectional view taken along the line 10—10 in FIG. 9;

DETAILED DESCRIPTION OF THE PREFERRED EMBODIMENTS

Figure 1:
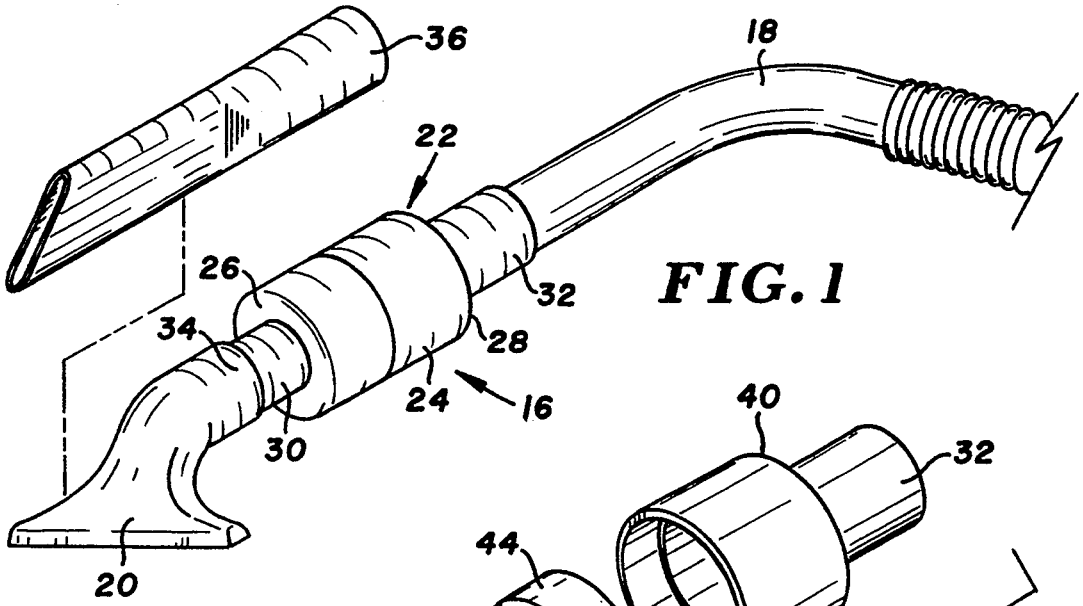
FIG. 1 is a perspective view of a retrieval and collection attachment, according to the present invention, removably coupled in-line to a portable vacuum cleaning system.

Turning now to the drawings, there is shown in FIG. 1 a retrieval and collection device 16, mounted in-line to a portable vacuum cleaning system that includes a vacuum hose 18 downstream of the collection device, and a pick-up attachment 20 mounted upstream of device 16. The vacuum cleaning system includes further components that are not shown, but are well known, e.g. an electric motor for drawing air downstream through the attachments and the hose, an electrical cord for connecting the electric motor to a power supply, and a canister or vacuum cleaner bag at the downstream end of hose 18 for collecting dust, debris and objects carried by the air stream, which is directed into the canister or bag. Also not illustrated, but well known, are vacuum cleaning systems of the "wet/dry" type, capable of drawing water or other liquids through the hose and any further attachments. The basic principle is the same, in that dirt and objects suspended in the fluid are carried with the fluid to the canister.

Retrieval device 16 is removably coupled within the vacuum cleaning system. The device includes a substantially rigid annular outer casing 22 with a relatively large medial region 24, upstream and downstream end walls 26 and 28 at opposite ends of the medial region, an upstream sleeve 30 extending away from upstream wall 26 and a downstream sleeve 32 extended away from the downstream wall.

Retrieval device 16 is removably coupled within the vacuum cleaning system. More particularly, pick-up attachment 20 has a conventional, friction-fit female coupling 34 at its downstream end. Upstream sleeve 30 is tapered to provide a male coupling, insertable into coupling 34 of the attachment for a friction fit. Similarly, vacuum hose 18 has a tapered male coupling at its upstream end, and downstream sleeve 28 has an internal taper such that the sleeve functions as a female coupling to receive the male coupling of the hose. Accordingly, retrieval device 16 is quickly and conveniently inserted into and removed from the vacuum system by a push-pull action.

Also shown in FIG. 1 is a wand or crevice attachment 36, which can be coupled at the upstream end of retrieval device 16 in lieu of attachment 20. Any form of upstream attachment can be mounted in this manner and used with the retrieval device, so long as it incorporates the conventional tapered friction-fit coupling. As a further alternative, no such attachment is used and the retrieval device forms the upstream end of the vacuum system.

Figure 2:
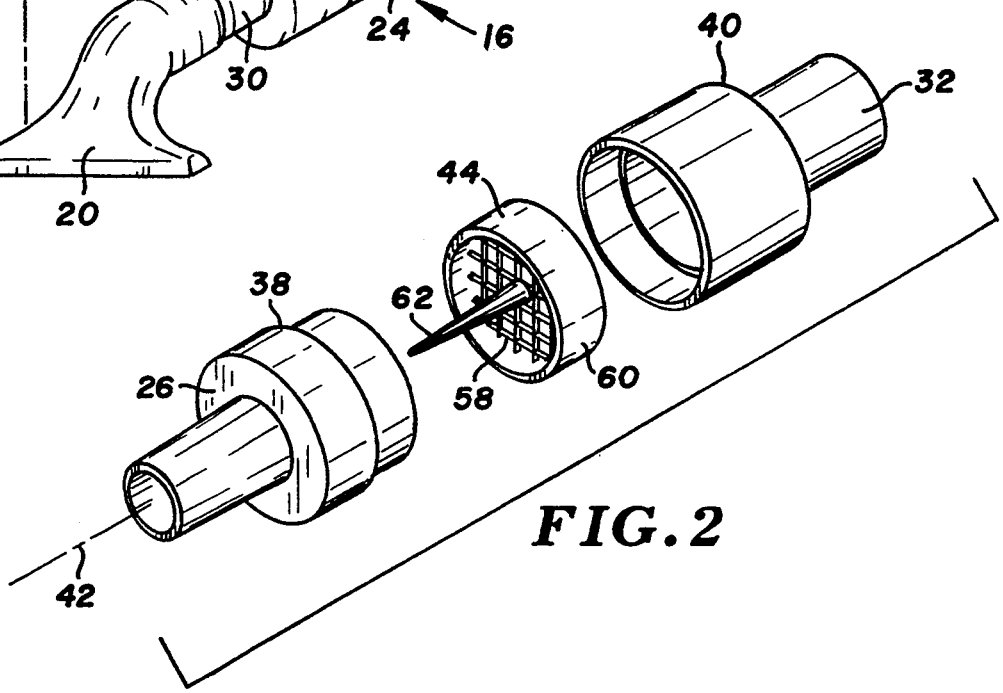
FIG. 2 is an exploded parts perspective view of the attachment in FIG. 1.

In FIG. 2, retrieval device 16 is shown in exploded view to reveal that casing 22 consists of two sections: an upstream casing section 38 and a downstream casing section 40. When coupled, the radially enlarged portions of sections 38 and 40 cooperate to form medial region 24, and also define a cylindrical chamber. The medial region and sleeves are concentric on a longitudinal central axis 42. A partition device 44 is contained within the chamber. Partition device 44 is free to move longitudinally within the chamber, but also is centered on axis 42. The casing sections and partition device preferably are constructed of a transparent plastic, e.g. a cellulose plastic or a high density polyethylene.

Figure 3:
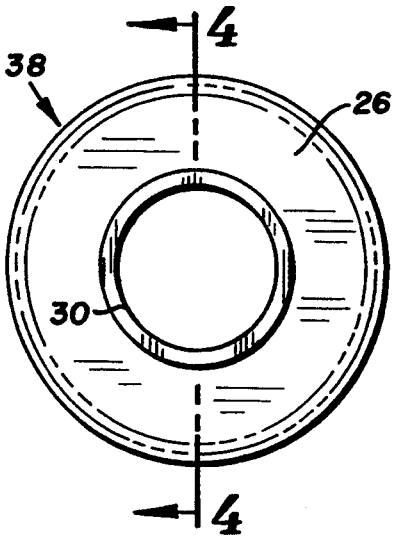
FIG. 3 is an end view showing one of two casing sections of the attachment.
Figure 4:
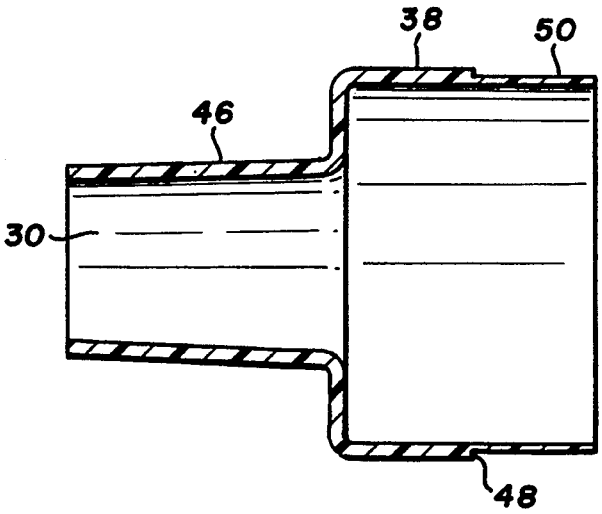
FIG. 4 is a sectional view taken along the line 4—4 in FIG. 3.

FIGS. 3 and 4 illustrate further details of upstream casing section 38. Sleeve 30 is shown with a somewhat exaggerated taper in its outer surface 46. The actual taper is approximately 1.5 degrees which corresponds to the taper of standard vacuum component couplings. Upstream wall 26 is substantially transverse, or vertical as viewed in FIG. 4. A downstream end region of casing section 38 is recessed to provide a step 48 and an annular mating surface 50 to facilitate forming an engagement with downstream casing section 40.

The concentricity of sleeve 30 and medial region 24 is best seen in FIG. 3. Sleeve 30 has a diameter of about 1.5 inches. The diameter of the enlarged portion, i.e. the medial region, is approximately 3 inches, in any event preferably at least twice the sleeve diameter. Thus the cross-sectional area of the chamber, taken in a transverse plane, is at least four times the corresponding cross-sectional area of the sleeve.

Downstream casing section 40 is shown in greater detail in FIGS. 5 and 6. Downstream sleeve 32 has an annular internal surface 52 tapered 1.5 degrees. Downstream wall 28 is transversely oriented and couples sleeve 32 and the enlarged annular portion of the casing section forming the medial region. An upstream end region of casing section 40 is recessed to provide a mating surface 54 and a step 56. When the casing sections are coupled to one another, mating surfaces 50 and 54 are contiguous.

As seen in FIGS. 7 and 8, partition device 44 includes a substantially flat and disc-shaped screen 58, an annular collar 60 surrounding and integral with the screen, and an elongate handle 62 extending longitudinally from the center of screen 58. Screen 58 is formed in the pattern of a grid to define multiple substantially square openings through the screen as indicated at 64. Openings 64 are uniform in size, except for the openings at the screen periphery adjacent collar 60. Openings 64 are sized to provide a coarse screen, in the sense that objects having diameters or other end-to-end dimensions of more than about $\frac{3}{8}$ of an inch, cannot pass through screen 58.

Collar 60 supports and stabilizes screen 58 by virtue of its thickness (in the radial direction) and its axial length. The outer diameter of collar 60 is slightly less than the inside diameter of casing medial region 24 to allow freedom of axial movement of partition device 44 within the chamber, and to facilitate insertion and removal of the partition device into and out of chamber.

As best seen in FIG. 8, the axial length of collar 60 is substantially greater than the axial thickness of screen 58. The greater axial collar length of course increases the strength and rigidity of collar 60. The axial length serves two further purposes, however. First, it controls and stabilizes the orientation of screen 58 within casing 22 while device 44 remains free to move axially relative to the casing. More particularly, the collar axial length, in combination with the close proximity of the collar to the casing inside wall, prevents any substantial tilting of the partition device out of the preferred axial alignment and concentricity.

Secondly, collar 60 functions as a spacer to insure at least a desired minimum axial distance between screen 58 and each of end walls 26 and 28. This is because screen 58 is substantially centered with respect to collar 60 in the axial direction, such that upstream and downstream axial extensions of the collar, indicated at 66 and 68 respectively, encounter end walls 26 and 28 to maintain the desired spacing between the screen and wall.

Handle 62 is elongate and frusto-conical, converging in the axial direction away from screen 58. Handle 62 is provided to facilitate manipulation of the partition device while loading the device into the chamber, removing it from the chamber and carrying objects and debris trapped by the screen.

FIGS. 9 and 10 illustrate a second partition device 70 including a fine screen 72, an annular collar 74 surrounding and integral with the screen, and a frusto-conical handle 76 projected axially away from the center of screen 72. Handle 76 and collar 74 are identical to their counterparts of partition device 44. Screen 72 differs from screen 58, in that the grid of screen 72 forms apertures 78 which are substantially smaller than the apertures through screen 58. For example, apertures 78 through fine screen 72 can be sized to capture objects having diameters (or other dimensions) of at least $\frac{1}{4}$ of an inch. Thus, when it is desired to capture smaller objects, partition device 70 is mounted into the chamber in lieu of partition device 44.

Figure 11:
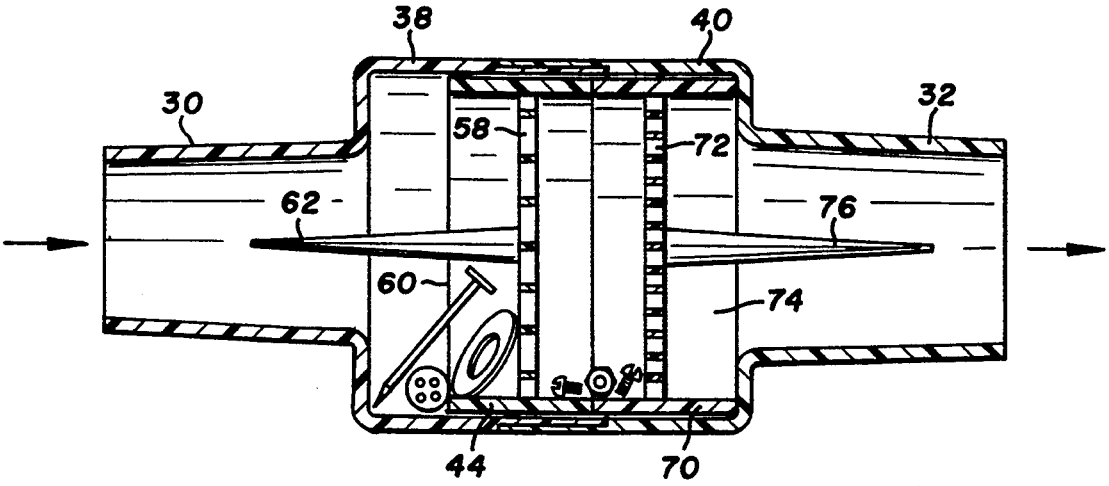
FIG. 11 is a diagrammatic view illustrating operation of the attachment with both screens inside the casing.

FIG. 11 illustrates an alternative configuration for utilizing retrieval device 16 to sort captured objects by enclosing partition device 44 and partition 70 within the chamber. In the retrieval configuration, either partition device alone is mounted inside of casing 22 to divide the chamber into upstream and downstream compartments. Objects above a predetermined size (depending on which screen is employed) are captured in the upstream compartment without any substantial interruption in the flow of air or other fluid, e.g. water in the case of a "wet/dry" vacuum cleaning system. By contrast, the sorting configuration employs both partition devices in tandem to divide the chamber into an upstream compartment 80, a medial compartment 82, and a downstream compartment 84. Objects having at least the larger of two predetermined sizes are captured in the upstream compartment. Objects having the smaller predetermined minimum size, but less than the larger size, are captured in the medial compartment. Given the length of handle 76, partition device 70 is inserted in a reverse orientation, i.e. with handle 76 pointing downstream.

Regardless whether device 16 employs the retrieval configuration or the sorting configuration, the shape of medial region 24 and its larger size as compared to sleeves 30 and 32 enhance operation. Normal operating conditions are steady state, i.e. with a substantially constant volumetric fluid flow rate throughout the attachments and hose 18. Given the constant volumetric flow, the average linear fluid velocity in the axial direction, taken over the entire span of the chamber, is less than the average linear velocity along sleeves 30 and 32. As the fluid velocity diminishes momentarily, so does the velocity of particles and objects suspended or otherwise carried by the fluid stream. This increase the tendency of such objects, particularly those of relatively larger size :and density, to be removed from the fluid stream by gravity. Such objects tend to settle within the upstream compartment, rather than being driven against and possibly clogging the screen. Secondly, the transverse orientation of end walls 26 and 28, as compared e.g. to gradually tapering end walls, cause greater turbulence into the fluid flow. Such turbulence interrupts the linear progression of the fluid and increases the tendency of objects to "settle" out of the fluid flow.

Figure 12:
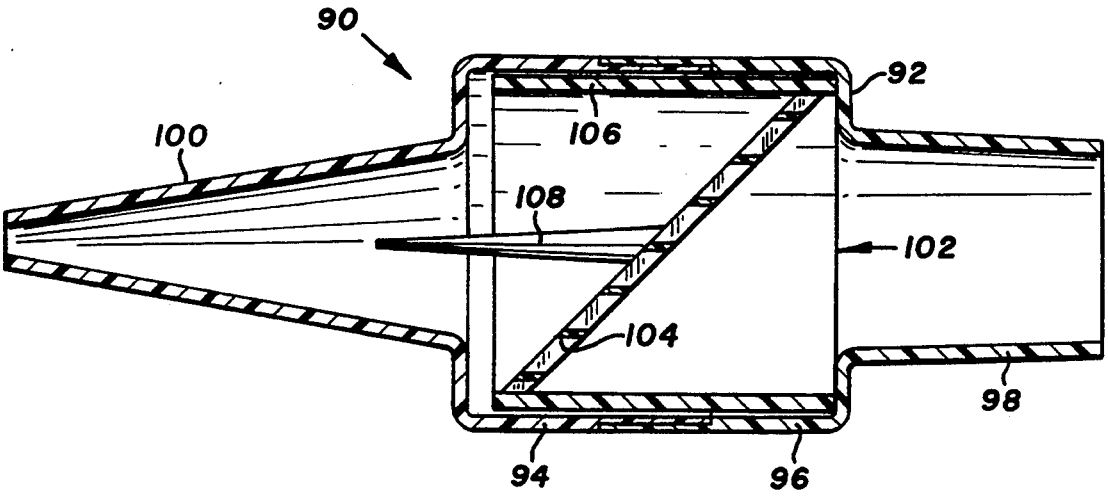
FIG. 12 is a side elevation in section, showing an alternative retrieval and collection attachment according to the present invention.

FIG. 12 shows an alternative collection and retrieval device 90 having a casing 92 formed of two separable casing sections 94 and 96, much in the same manner as casing 22. A downstream coupling sleeve 98 of casing 92 is substantially similar to downstream sleeve 32 of retrieval device 16. By contrast, an upstream sleeve 100 of retrieval device 90 differs from its counterpart in several respects. First, sleeve 100 is not coaxially aligned, but rather is inclined with respect to the medial region and sleeve 98. Secondly, sleeve 100 is tapered to provide a crevice tool or wand, effectively building a wand into the retrieval device and avoiding the need for an extra attachment. Counterbalancing this advantage is reduced flexibility since sleeve 100, unlike sleeve 30, is not suited for removable coupling to a variety of attachments.

A single partition device 112 is shown within the chamber formed by casing 92. The partition device includes a substantially flat, disc-like screen 114 surrounded by an integral annular collar 116. A frustoconical handle 118 projects axially upstream from the center of screen 114.

Screen 114 differs from its counterpart screens discussed above in that it is obliquely rather than transversely oriented. Screen 114 is elliptical rather than circular, and has a greater surface area as compared to a circular screen mounted within the same sized chamber. Thus, screen 114 tends to reduce the frequency of the need to disconnect casing sections 94 and 96 to empty the chamber.

Each of partition devices, whether featuring transverse or oblique screens, is fabricated as one piece by injection molding. The handle, particularly the remote end of the handle, conveniently serves as the sprue. The partition devices can be formed of the same materials employed in forming the casing, thus to be transparent. Transparency in the partition devices does not enhance retrieval device utility in the manner that casing transparency does, yet transparent partition devices improve the overall appearance of the retrieval device.

Thus, in accordance with the present invention, conventional portable vacuum cleaners can be equipped to retrieve and collect articles of a given size enabling recovery of such articles without searching through a vacuum cleaner canister or bag, and protecting downstream vacuum components from any damage that such articles might cause. Recognition of retrieved objects is enhanced by a transparent casing of the retrieval device and by the cleaning action as dust and other debris, smaller in size than the articles, are separated from the articles and carried downstream. The retrieval device can be quickly and conveniently attached in-line to a system employing conventional vacuum fittings without any need to alter the equipment. A variety of interchangeable partition devices with different sized screens can be employed to controllably alter the size of objects being retrieved. Finally, two Or more screens can be arranged in tandem whereby the retrieval device further sorts retrieved objects by size.

What is claimed is:

1. A retrieval device adapted for removable mounting in-line into a vacuum system via standard friction-fit couplings of vacuum system components; the retrieval device comprising:

a substantially rigid annular casing including a medial region defining a collection chamber, an upstream sleeve extended away from an upstream wall portion of the medial region, and a downstream sleeve extended away from a downstream wall portion of the medial region, wherein the upstream and downstream sleeves are in fluid communication with the collection chamber to accommodate flow of a fluid into and out of the collection chamber, wherein nominal diameters of the sleeves are each substantially less than a nominal diameter of the chamber;

a partition means in the chamber, including a substantially disc-shaped first screen spanning the chamber to divide the chamber into upstream and downstream compartments respectively upstream and downstream of the first screen, and multiple first apertures through the first screen and of a size selected to allow substantially uninterrupted flow of the fluid therethrough, while preventing passage of articles carried by the fluid and having at least a first predetermined size, thereby to capture the articles in the upstream compartment; and an alignment means for maintaining the first screen in a selected orientation within the collection chamber, axially spaced apart from the upstream and downstream wall portions, while permitting axial movement of the first screen relative to the casing;

wherein the casing includes two casing sections removably engaged with one another along the medial region to facilitate separation of the casing sections from one another to remove the articles from the chamber; and wherein at least the downstream sleeve is selectively shaped for a removable frictional engagement with a standard tapered coupling of a component of a vacuum system.

2. The retrieval device of claim 1 wherein:

the sleeves and the collection chamber are concentric on a longitudinal central axis, and the diameters of the sleeves are approximately equal to one another and at most one-half of the chamber diameter.

3. The retrieval device of claim 2 wherein:

the partition means further includes a substantially disc-shaped second screen spanning the chamber, spaced apart axially of and upstream of the first screen to divide said upstream compartment into first and second subcompartments, and multiple second apertures through the second screen of a size selected to prevent passage of articles carried by the fluid and having at least a second predetermined size larger than the first predetermined size, whereby the first and second screens cooperate to capture articles of at least the first predetermined size and less than the second predetermined size in the first subcompartment, and articles of at least the second predetermined size in the second subcompartment.

4. The retrieval device of claim 3 wherein:

the first and second screens are removably and interchangeably mounted in the chamber.

5. The retrieval device of claim 3 further including:

an alignment means for maintaining the first and second screens in a selected orientation and in axially spaced apart relation to one another and to the upstream and downstream wall portions, while permitting each of the screens to move axially relative to the casing.

6. The retrieval device of claim 5 wherein:

each of the first and second screens is removable from the chamber, independently of the other screen.

7. The retrieval device of claim 6 wherein:

the alignment means comprises a first collar surrounding and integral with the first screen and having collar portions extended in both axial directions from the first screen, and a second collar surrounding and integral with second screen and having collar portions extended in both axial directions from the second screen, each of the first and second collars having an outside diameter approximately equal to but slightly less than the chamber diameter.

8. The retrieval device of claim 7 wherein:

each of the first and second collars has an axial length at least one-third of the chamber diameter.

9. The retrieval device of claim 3 further including:

first and second elongate axially extended handles, attached to the first and second screens, respectively.

10. The retrieval device of claim 1 wherein:

the casing is constructed of a transparent polymeric material.

11. The retrieval device of claim 10 wherein:

the casing sections are frictionally engaged with one another.

12. The retrieval device of claim 1 wherein:

the upstream sleeve is selectively shaped for a removable frictional engagement with a standard tapered coupling of a component of the vacuum system.

13. The retrieval device of claim 1 wherein:

the first screen and the alignment means are removable from the chamber.

14. The retrieval device of claim 1 wherein:

the upstream and downstream wall portions are perpendicular to the central axis.

15. The retrieval device of claim 1 wherein:

the alignment means includes a collar surrounding and integral with the first screen and having portions extended in both axial directions from the screen, said collar having an outside diameter substantially equal to but less than the diameter of the chamber, to permit axial sliding of the collar and first screen relative to the casing.

16. The retrieval device of claim 15 wherein:

the axial dimension of the collar is at least one-third of the chamber diameter.

17. The retrieval device of claim 1 wherein:

the first screen is oriented perpendicular to the longitudinal central axis.

18. The retrieval device of claim 1 wherein:

the first screen is oriented obliquely with respect to the longitudinal central axis.

19. The retrieval device of claim 1 further including:

a handle mounted to the first screen approximately centrally of the first screen, and extended axially away from the first screen.

20. A retrieval device adapted for in-line mounting in a vacuum system, including:

a substantially rigid annular casing including medial region defining a collection chamber, an upstream sleeve extended away from the upstream wall portion of the medial region, and a downstream sleeve extended away from the downstream wall portion of the medial region, wherein the upstream and downstream sleeves are in fluid communication with the collection chamber to accommodate flow of a fluid into and out of the collection chamber, wherein nominal diameters of the sleeves are each substantially less than a nominal diameter of the chamber; and a partition means in the chamber, including substantially disk-shaped first and second screens spanning the chamber and spaced apart axially from one another to divide the chamber into upstream, medial and downstream compartments with the medial compartment being between the upstream and downstream compartments, said second screen being axially upstream of the first screen;

wherein the first screen includes multiple first apertures therethrough of a size selected to allow substantially uninterrupted flow of the fluid therethrough while preventing passage of articles carried by the fluid and having at least a first predetermined size;

wherein the second screen includes multiple second apertures therethrough of a size selected to prevent passage of articles carried by the fluid and having at least a second predetermined size larger than the first predetermined size, the first and second screens cooperating to capture articles of at least the first predetermined size and less than the second predetermined size in the medial compartment, and articles of at least the second predetermined size in the upstream compartment; and wherein the casing includes two casing sections removably engaged with one another along the medial region to facilitate separation of the casing sections from one another to remove the articles from the chamber.

* * * * *